United States Patent [19]

de Leaumont

[11] 4,155,210

[45] May 22, 1979

[54] PROCESS FOR BUILDING UP TOWERS, PARTICULARLY WATER TOWERS

[75] Inventor: Jean de Leaumont, Paris, France

[73] Assignee: Le Ciment Arme Demay Freres, Marne, France

[21] Appl. No.: 808,878

[22] Filed: Jun. 22, 1977

[30] Foreign Application Priority Data

Nov. 22, 1976 [FR] France ..... 76 35160

[51] Int. Cl.[2] ..... E04B 1/16; E04G 21/00

[52] U.S. Cl. ..... 52/745; 52/245; 52/236.2

[58] Field of Search ..... 52/236.2, 247, 246, 52/245, 224, 745; 264/34, 32

[56] References Cited

U.S. PATENT DOCUMENTS

| | | | |
|---|---|---|---|
| 1,086,295 | 2/1914 | Hillman | 52/224 |
| 1,488,177 | 3/1924 | Sider | 52/224 |
| 1,497,141 | 6/1924 | Hart | 52/224 |
| 3,300,942 | 1/1967 | Horstman | 52/80 |
| 3,468,087 | 9/1969 | Stancliffe | 52/236.2 |
| 4,010,580 | 3/1977 | Mayer | 52/80 |
| 4,045,929 | 9/1977 | Dalbrenta | 52/245 |

FOREIGN PATENT DOCUMENTS

| | | | |
|---|---|---|---|
| 2209978 | 9/1973 | Fed. Rep. of Germany | 52/80 |
| 111151 | 7/1944 | Sweden | 52/247 |

*Primary Examiner*—John E. Murtagh

*Attorney, Agent, or Firm*—Mason, Kolehmainen, Rathburn & Wyss

[57] ABSTRACT

(a) A process for building up towers consisting of a surface particularly not cylindrical which consists of elements at least corresponding to a large fraction of the height of the construction.

(b) A process wherein molds corresponding to the length of the elements are achieved and subdivided so as to make only segments corresponding to a portion of each said elements, the size of said segments being selected in order to allow handling thereof, then the elements are placed side by side thus reconstituating said elements from corresponding segments of the molding.

3 Claims, 14 Drawing Figures

Fig: 4
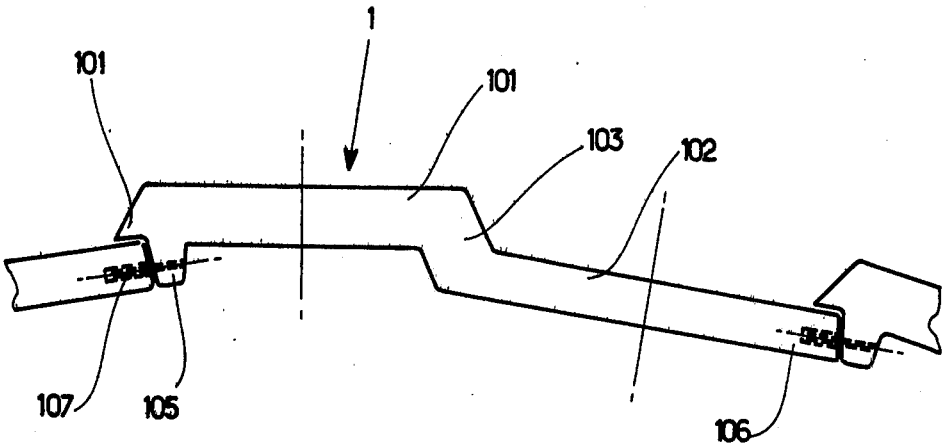
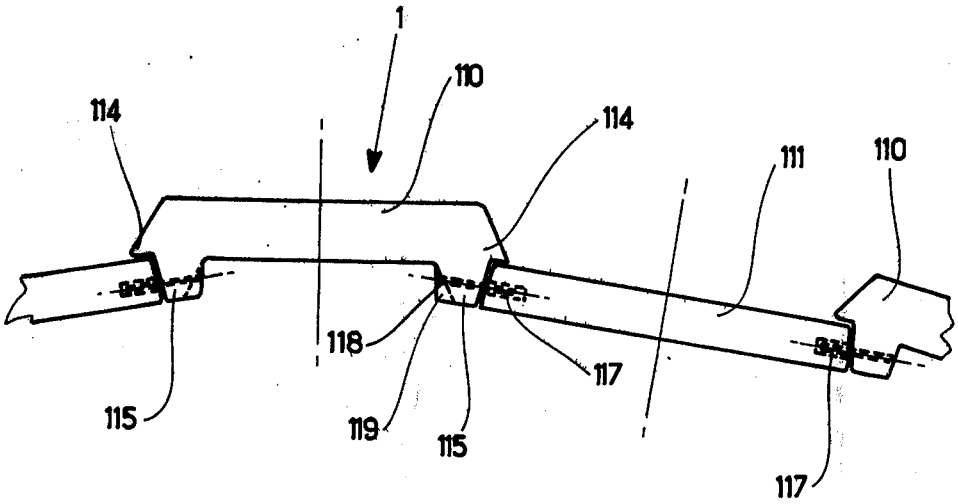
Fig: 5

Fig:6
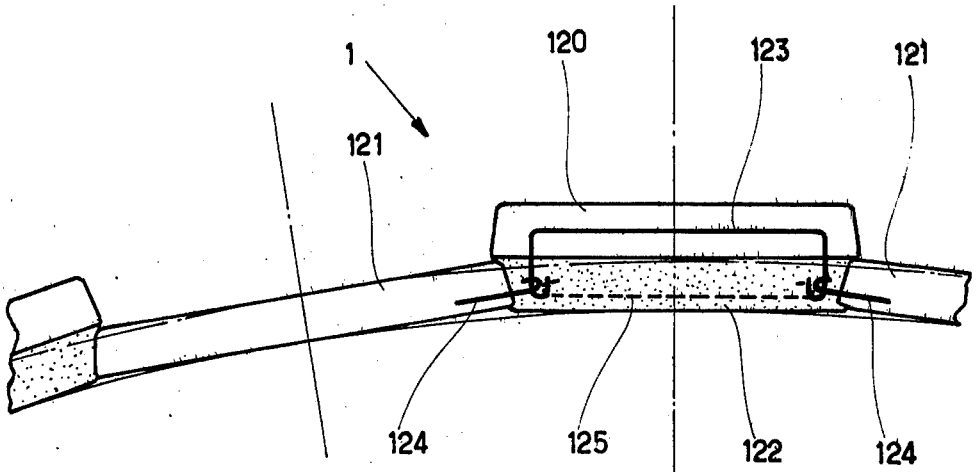
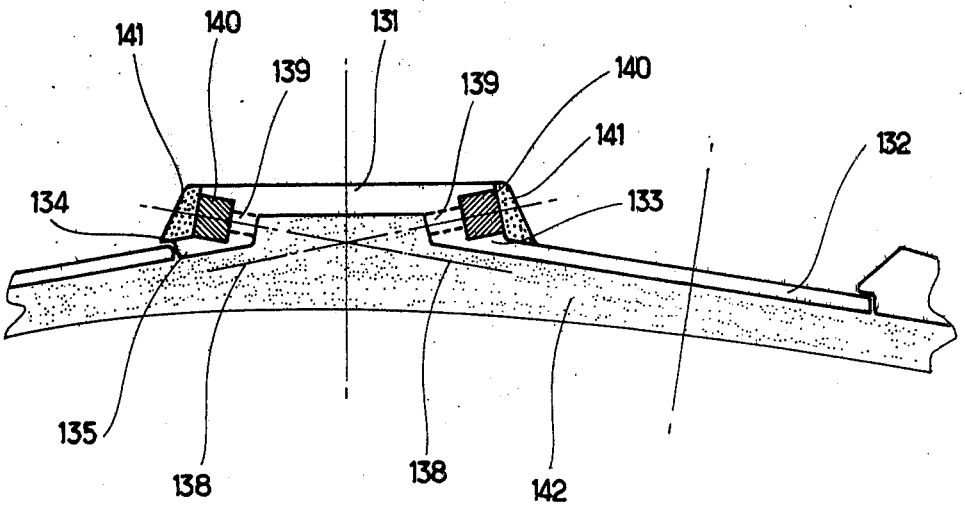
Fig:7

Fig: 8
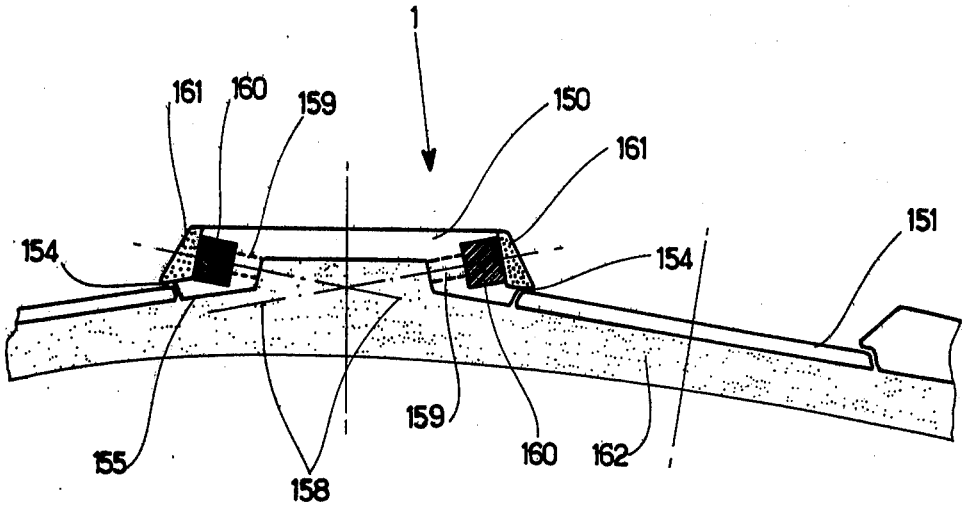
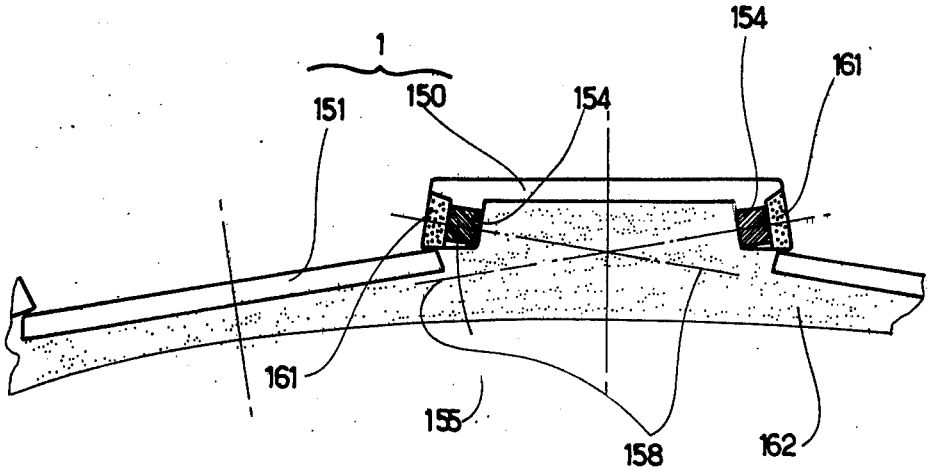
Fig: 9

PROCESS FOR BUILDING UP TOWERS, PARTICULARLY WATER TOWERS

The present invention provides a process for building up towers, particularly water towers.

For the time being, water towers built up are achieved by craftsmen, from a casing, then mounted little by little.

Such a way of proceeding involves a great quantity of materials, requires an important labour and a rather loss of time as well.

Processes for building up towers have already been suggested, such as water towers by means of modular elements; but, such processes do not make it possible to achieve cylindrical towers from elements identical to one another. When it is sought to make towers somewhat bent for example, originated by the rotation of a curve about a vertical axis, which makes them cub-shaped, problems difficult to solve are met with from the aesthetic point of view. As a matter of fact, through superposition of bent elements, it is extremely difficult to obtain a real continuity of the curve and thereby only deformed towers are obtained, then unacceptable.

The present invention is aimed to remedy these drawbacks.

To this end, the invention provides a process wherein molds corresponding to the length of the elements are achieved, and afterwards said molds are subdivided so as to only make segments, corresponding to a portion of each element, the size of said segments being selected so as to allow the handling thereof, then said elements are placed side by side by means of the segments by making sure that said elements are subdivided into segments when molding is performed.

Thus, it is possible to achieve towers consisting of modular elements which can be industrially achieved on the ground direct. As the total height of the construction or a large portion thereof consist of one and the same element, and that said element is itself achieved in one and the same mold, by dividing said element into as much segments as required to handle them without any difficulty then by reconstituting said segments on the spot, a remarkable continuity of the curve of the element is obtained and, thus, of all the construction, whatever the complexity or the variations in the radius of the curves.

According to a further characteristic feature of the invention, belts are positioned around the construction on a level with the junctions so as to ensure a better repartition of the efforts.

According to another characteristic feature of the invention, the lateral edges of the elements (or of the segments constituting the elements) are provided with grooves said grooves being designed to co-operate one another so as to make channels themselves designed to receive concrete, glue or any water-proof means.

Also, the invention relates to elements of construction for working out the process, said elements being characterized in that the corresponding edges of the segments carry embossings and grooves designed to subsequently facilitate the assembling of the segments to each other in order to reconstitute each element through encasing.

The present invention will be disclosed with more details by means of various modes of embodiment diagrammatically shown in the attached drawings, wherein:

FIG. 4 is a diagrammatical horizontal cross-section view of the assembling of three elements according to the first mode of embodiment shown in FIG. 2.

FIG. 5 is a diagrammatical cross-section view of a variant in elements shown in FIG. 4.

FIG. 6 is a cross-section view of another variant in elements shown in FIG. 4.

FIG. 7 is a cross-section view corresponding to the mode of embodiment shown in FIG. 4, where elements serve as casings.

FIG. 8 is a cross-section view of a variant of FIG. 7.

FIG. 9 is a cross-section view of a further variant of FIG. 7.

Figure 1:
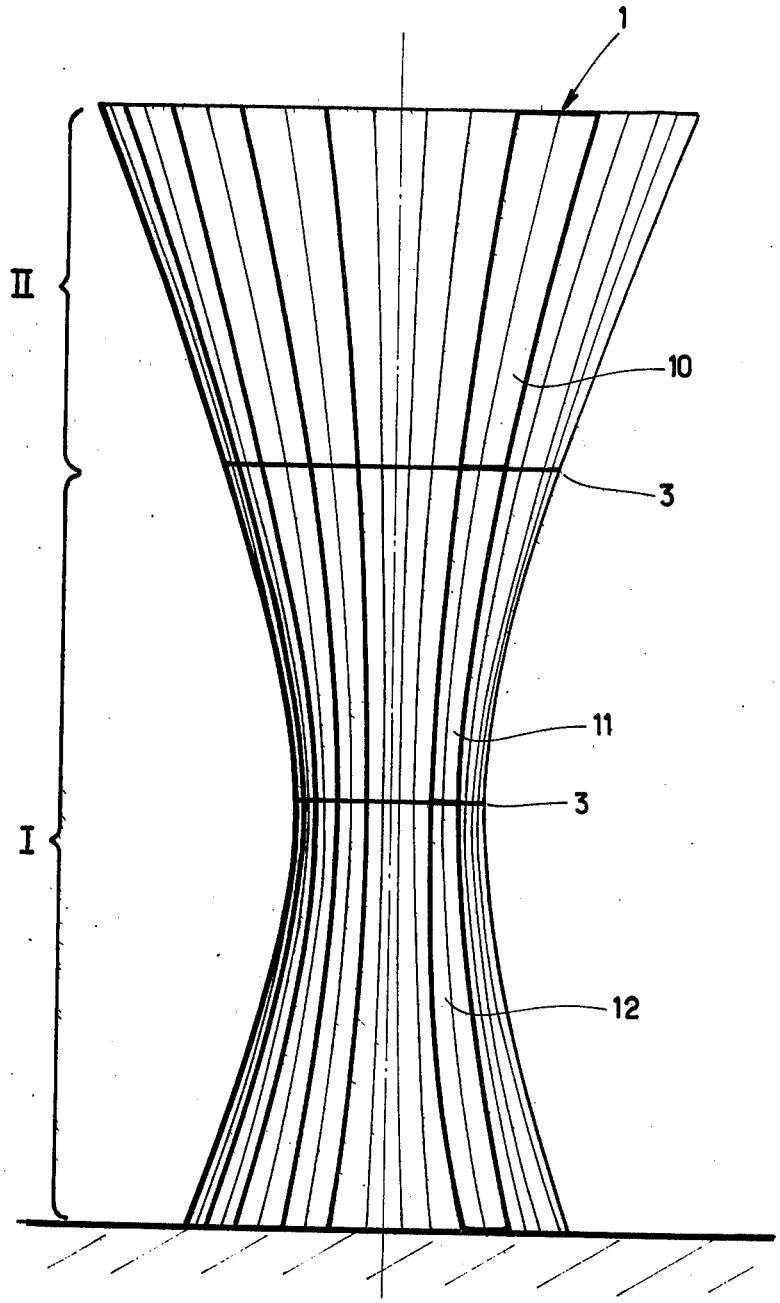
FIG. 1 is a side comprehensive view of a water tower.

As shown in FIG. 1, a construction according to the invention which may be a water tower consists of a shaft I and of a tank II. Said shaft I and tank II are formed by placing great length elements side by side so as to obtain a corrugated framework or the like. Each element I is formed by assembling several segments 10, 11, 12 together achieved by subdividing the mold of the element 1 into compartments when casting is performed so as to obtain segments 10, 11, 12 easy to carry and handle. Such a way of proceeding to achieve the various segments 10, 11, 12. . . from one and the same element 1 in one and the same mold makes it sure that when the whole of the element 1 will be reconstituted on the spot it will show the curve sought. This is particularly important where surfaces whose curve radius change are involved, because any default in the standard achievement appears when the construction is finished, which is very embarrassing.

The molding in one and the same mold makes it possible to remedy these drawbacks.

As shown in the drawing, the construction is partly symmetrical in relation to a horizontal plane.

Depending on the case, reinforcing belts 3 may be provided which consist of cables or the like, equally spaced from each other along the shaft I so as to ensure a better distribution of efforts.

Figure 2:
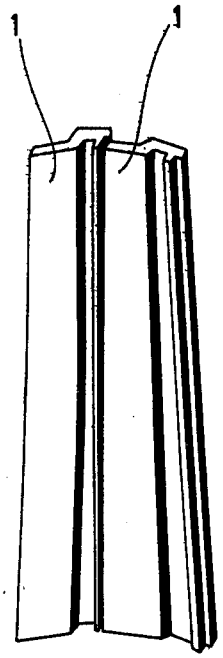
FIG. 2 is a part perspective view of two elements according to a first mode of embodiment of the invention.

The perspective view in FIG. 2 shows the assembling of two elements corresponding to the construction shown in FIG. 1.

The elements and the assembling mode thereof are disclosed with more details hereafter by making reference to FIGS. 4 to 9 and 11 to 14.

Figure 3:
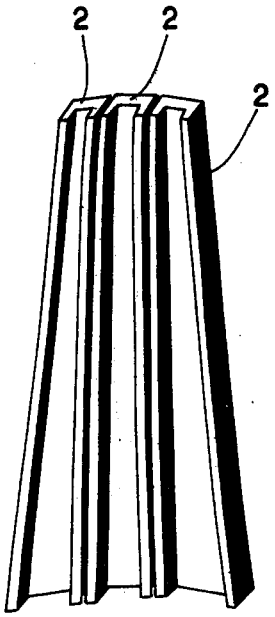
FIG. 3 is a part perspective view of three elements according to a second mode of embodiment of the invention.
Figure 10:
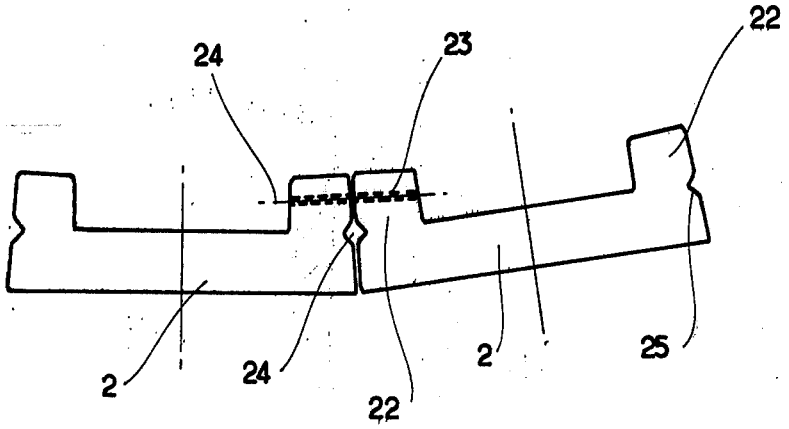
FIG. 10 is a cross-section view of two elements shown in FIG. 3.

The perspective view of FIG. 3 shows the assembling of three elements 2 according to a further mode of embodiment of the invention which will be disclosed with more details by making reference to FIG. 10.

The element 1 consists of a projecting portion 101 and of a recessed portion 102. Both portions 101 and 102 are connected to each other by an intermediate portion 103. The three portions 101, 102, 103 are made in one and the same piece. The free end of the portion 101 ends in a rebate 104 and in a heel 105. On the other hand, the free end 106 of the portion 102 does not carry neither cutting nor rebate. The thickness of the heel 105 is the same as that of the portion 102 so that said portion 102 might imbricate both the rebate and heel 104, 105 so as to make a connection through an element 107 possible, diagrammatically shown in FIG. 4. Said connecting element 107 may also be an anchoring or framework means.

According to the variant in the mode of embodiment shown in FIG. 5, contrary to the mode of embodiment shown in FIG. 4, the element 1 is in two distinct portions 110, 111. The portion 110, symmetrical in shape, carries a rebate 114 and a heel 115 at each end thereof. On the other hand, the portion 111 is rectilinear where shown in cross-section and does not carry any heel or rebate. Said portion 111 is embedded between the rebate 114 and the heel 115 of two successive portions 110 as shown in the right hand part of FIG. 5.

The portions 110 and 111 are connected to each other by connecting or anchoring means 117.

Said connecting means 117 consists, for example, of a threaded socket, not referenced, fixed to the portion 111 and receiving a bolt or a threaded rod set into an aperture 118 of the heel 115 of the portion 110. An open portion 119 permitting to introduce same and to reach the connecting means is shown in dotted lines in the Figure.

The cross-section view of FIG. 6 corresponds to a variant of FIG. 5. As a matter of fact, each element 1 consists of two parts 120 and 121 different from each other. Contrary to the mode of embodiment shown in FIG. 5, the part 120 does not carry any rebate or shoulder. The same applies to the part 121. Both parts 120 and 121 of each element 1 may be connected either temporarily or definitely to one another so as to make it possible to perform casting of the portions 122, 120 and 121 constituting a casing.

As shown in FIG. 6, the portion 120 carries a steel clamping means 123 whose ends carry hooks co-operating with the framework steels 124 projecting from each side of the contiguous elements 121. Finally, in order to transmit efforts, a connecting element 125 is provided. The connecting framework and clamping elements are bedded into the concrete of the portion 122 which makes a keying which can also contain vertical frameworks ensuring the reinforcement of the connections between segments in succession.

The variants of realization diagrammatically shown in part cross-section in FIGS. 7, 8 and 9 correspond to elements 1 according to various variants, and which serve as casings. The modes of embodiment shown in FIGS. 7, 8 and 9 can be used either in lieu of those previously disclosed, or where it is needed to reinforce the construction, for example, in a level with a tank or the like.

As shown in FIG. 7, there is an element 1 similar to the element 1 of FIG. 4, although different therefrom in that the portions 131 and 132 are thinner than the corresponding portions 101 and 102 of FIG. 4. Besides, the connecting portion 133 is reinforced so as to make it possible to secure framework or reinforcing elements diagrammatically shown by the lines 138. Passages 139 extended by a recess 140 for the clamping element, such as a bolt or a preconstraint anchorage, etc. . . . , are provided in the intermediate portion 133. In the mode of embodiment shown in FIG. 7, the portion 131 which is made in one and the same piece with the portions 132 and 133, carries a heel whose shape is partly symmetrical with the portion 133. Also, said heel carries a passage 139 and a cavity 140. Finally, the portion 131 carries a rebate 134. Concrete 141 has been cast on a level with the cavity 140 of the heel 135 or of the intermediate piece 133.

The elements 1 thus assembled together as shown in FIG. 7, with or without any reinforcement or framework means 138, serve as external casings to cast concrete 142 therein. The inner casing is not shown in FIG. 7.

FIG. 8 shows a mode of embodiment identical to that of FIG. 7, as per the variant of FIG. 5. As a matter of fact, as shown in FIG. 8, the element 1 consists of two portions 150 and 151 respectively corresponding to the portions 110 and 111 of FIG. 5, excepting the thickness, which depending on the case may be smaller than that of the portions 150 and 151. The portions 150 and 151 are distinct.

The portion 150, symmetrical-shaped, carries at each of its edges a heel 155 and rebates 154 to allow the positioning of the portions 151. Passages 159 are provided in the heels for the framework or reinforcement elements 158 diagrammatically shown with thin lines in FIG. 8. Said passages 159 end by cavities 160 designed to receive the clamping element, such as a bolt, screwed at the ends of the reinforcement elements, or a preconstraint anchorage. All the cavities 160 are closed by concrete or cement 161 so as to be levelled with the shape of the rebate 154.

The portions 150 and 151 thus fitted together with or without any reinforcing or framework elements serve as an external casing to cast the concrete 162. The internal casing is not shown in this Figure.

The mode of embodiment shown in FIG. 9 is very likely to that shown in FIG. 8 and therefore the similar pieces and elements bearing the same references will not be described.

The only difference rests in that the heels 155 do not carry any rebate as those shown in FIG. 8.

FIG. 10 shows a second mode of embodiment of elements 2 according to the invention. Said elements 2 achieved as the elements 1 inside one and the same mold subdivided into compartments corresponding to segments are U-shaped, and consist of a main portion 21 and two tongues 22. Assembling is performed through said tongues which may carry passages 23 for an anchoring or connecting means 24 diagrammatically shown by a line in FIG. 10. Furthermore, the external surface of said tongues 22 carries a groove 25. When both elements 2 are assembled to one another, the grooves combine to make a duct 24 wherein concrete is cast, or glue or any other tightness means, thus closing the junction between the two elements 2 placed side by side.

Figure 11:
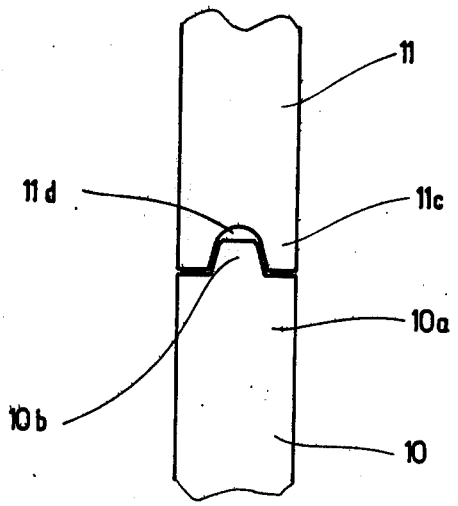
FIG. 11 is a part vertical cross-section view on a level with the assembling of two superposed segments.

FIG. 11 shows an assembling mode of two segments 10, 11. The upper end **10*a* of the segment 10 carries an embossing 10*b* extending for example all along the upper edge of said segment 10. The lower end 11*c* of the segment 11 carries a cavity 11*d* whose shape corresponds to that of the embossing 10*b*. The ends 11*c* and 10*a* are thus set into one another. So as to facilitate the connection and to compensate any possible defaults it is advantageous that the embossing 10*b* has a trapezoidal section and that the groove 11*d*** has a corresponding shape.

It is clear that the upper edge, not shown, of the segment **11*d* carries an embossing similar to the embossing 10***b* of the segment 10. Inversely, the lower portion of the segment 10 carries a groove similar to the groove 11*d* of the segment 11.

Figure 12:
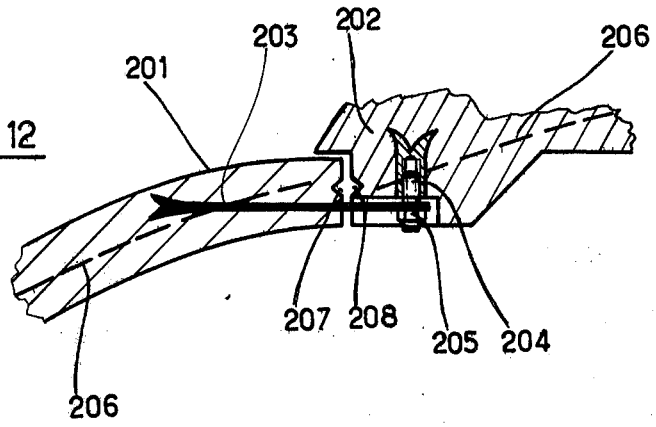
FIGS. 12, 13 and 14 show three variants of the anchoring and connecting means between the elements.
Figure 13:
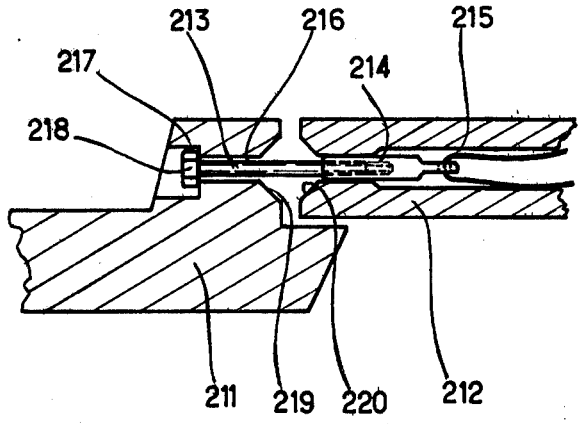
Figure 14:
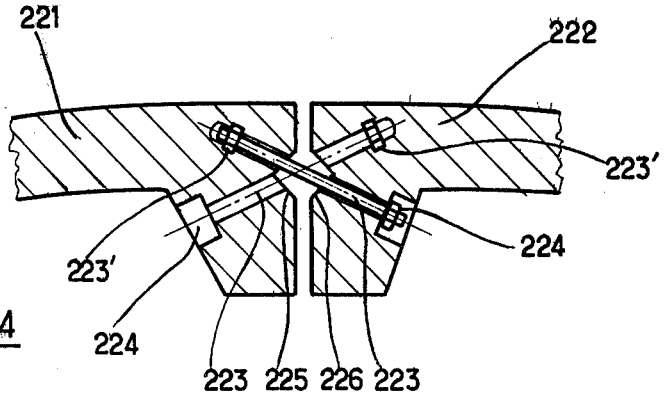

FIGS. 12, 13 and 14 diagrammatically show various modes of assembling and anchoring of two segments or portions of segments.

As shown in FIG. 12, the segment or portion of segment 201 is connected to the segment or portion of segment 102 by means of a tongue 203 bedded into the portion 201. The front end of the tongue carries an aperture enabling to connect said tongue with the socket 204 bedded into the portion 202. A bolt 205 completes the assembling. Said FIG. 12 also shows the irons or reinforcing elements 206, 206 diagrammatically shown which respectively reach the level of the threaded rod 204 and that of the tongue 203 so as to ensure the transmission of efforts in a level with the junction.

At the level of their opposite surfaces the portions 201 and 202 carry a longitudinal groove 207, 208. The combination of said two grooves 207, 208 makes a tube which is filled in with concrete or glue or any other insulating means.

FIG. 13 shows a further mode to assemble elements or portions of elements 211, 212. In the mode of embodiment, there is a threaded socket 213 whose flattened end carries an aperture 214 for the passage of an anchoring iron 215 securing said threaded socket 213 into the portion 212.

The other piece 211 carries a passage 216 for the threaded rod as well as a recess 217 to receive the nut 210 of the threaded rod or the head of the bolt screwed inside the threaded socket. Finally, as formerly, both the opposite surfaces carry grooves 219, 220 making a duct which is filled in with concrete, glue or any other insulating means.

FIG. 14 diagrammatically shows the assembling of two portions 221, 222 identical to one another at least in a level with their junction and of a symmetrical assembling. Said Figure diagrammatically shows the connecting elements 223 (threaded rods) an end of which is screwed into a nut or threaded socket 223 bedded inside each portion 222, 221, the other end thereof being secured to the other piece by a bolt or the like coming into the respective cavities 224. As precedently, both the opposite surfaces carry grooves 225, 226 the combination of which forms a channel receiving concrete, a glue or any other insulating means.

Of course, the invention is not limited to the modes of embodiment disclosed and depicted hereabove, from which other forms and modes of embodiment can be provided without thereby departing from the scope of the invention.

I claim:

1. A process for the construction of a tower having a non-cylindrical surface formed by a plurality of elongated upstanding elements of a length at least corresponding to a large portion of the height of said tower, said process comprising the placement of a mold corresponding to the length of the elements to be formed at the site where the tower is to be constructed, said molds being subdivided into compartments so as to make molded wall segments corresponding to a portion of the length of each element, the size of said segments being selected so as to allow the handling thereof, filling said molds to cast said elements, removing said cast elements from the molds, placing said elements in upstanding position side by side and interconnecting the adjacent edges thereof and, each of said elements including a plurality of segments cast from said mold.

2. The process according to claim 1, including one or more belts encircled around the assembled elements on a horizontal plane.

3. The process according to claim 2, wherein one face of said elements includes a groove forming a channel for receiving cementitious material.

* * * * *